US009850446B2

(12) United States Patent
Iwasaki et al.

(10) Patent No.: US 9,850,446 B2
(45) Date of Patent: Dec. 26, 2017

(54) LUBRICANT COMPOSITION

(71) Applicant: IDEMITSU KOSAN CO., LTD., Chiyoda-ku (JP)

(72) Inventors: Junya Iwasaki, Ichihara (JP); Yasunori Shimizu, London (GB)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/892,094

(22) PCT Filed: May 20, 2014

(86) PCT No.: PCT/JP2014/063381
§ 371 (c)(1),
(2) Date: Nov. 18, 2015

(87) PCT Pub. No.: WO2014/189057
PCT Pub. Date: Nov. 27, 2014

(65) Prior Publication Data

US 2016/0115419 A1 Apr. 28, 2016

(30) Foreign Application Priority Data

May 20, 2013 (JP) ..... 2013-106598

(51) Int. Cl.

| | |
|---|---|
| ***C10M 129/50*** | (2006.01) |
| ***C10M 129/48*** | (2006.01) |
| ***C10M 133/48*** | (2006.01) |
| ***C10M 133/00*** | (2006.01) |
| ***C10M 141/06*** | (2006.01) |
| ***C10M 101/02*** | (2006.01) |
| ***C10M 129/70*** | (2006.01) |
| ***C10M 129/72*** | (2006.01) |
| ***C10M 133/40*** | (2006.01) |

(52) U.S. Cl.
CPC ..... *C10M 141/06* (2013.01); *C10M 101/02* (2013.01); *C10M 129/70* (2013.01); *C10M 129/72* (2013.01); *C10M 133/40* (2013.01); *C10M 2203/1025* (2013.01); *C10M 2207/026* (2013.01); *C10M 2207/028* (2013.01); *C10M 2207/289* (2013.01); *C10M 2215/064* (2013.01); *C10M 2215/221* (2013.01); *C10M 2215/223* (2013.01); *C10M 2215/28* (2013.01); *C10M 2223/045* (2013.01); *C10M 2229/02* (2013.01); *C10N 2210/02* (2013.01); *C10N 2230/04* (2013.01); *C10N 2230/08* (2013.01); *C10N 2230/10* (2013.01); *C10N 2230/42* (2013.01); *C10N 2230/45* (2013.01); *C10N 2230/52* (2013.01); *C10N 2240/10* (2013.01); *C10N 2240/102* (2013.01); *C10N 2260/14* (2013.01)

(58) Field of Classification Search
CPC ..... C10M 141/06; C10M 129/70; C10M 129/72; C10M 101/02; C10M 133/40; C10M 2207/028; C10M 2215/064; C10M 2215/221; C10M 2215/223; C10M 2215/28; C10M 2223/045; C10M 2207/026; C10M 2207/289; C10M 2203/1025; C10M 2229/02; C10M 2215/22; C10M 2207/284; C10N 2230/08; C10N 2210/02; C10N 2230/04; C10N 2230/10; C10N 2230/42; C10N 2230/45; C10N 2230/52; C10N 2240/10; C10N 2240/102; C10N 2260/14; C10N 2220/022
See application file for complete search history.

(56) References Cited

U.S. PATENT DOCUMENTS

| | | | | | |
|---|---|---|---|---|---|
| 5,268,113 | A * | 12/1993 | Evans | C10M 133/02 | 252/401 |
| 5,686,398 | A * | 11/1997 | Minokami | C07C 69/88 | 44/389 |
| 2008/0051306 | A1* | 2/2008 | Chasan | C10M 133/40 | 508/267 |
| 2008/0221000 | A1* | 9/2008 | Chase | C10M 133/02 | 508/262 |
| 2010/0249000 | A1 | 9/2010 | Kamano | | |
| 2013/0130954 | A1 | 5/2013 | Kamano | | |

FOREIGN PATENT DOCUMENTS

| | | | | |
|---|---|---|---|---|
| CH | GB 2253411 A * | 9/1992 | C10M 141/10 | |
| JP | 7-062371 A | 3/1995 | | |

(Continued)

OTHER PUBLICATIONS

Extended European Search Report dated Dec. 15, 2016 in patent application No. 14801604.1.

(Continued)

*Primary Examiner* — Pamela H Weiss
(74) *Attorney, Agent, or Firm* — Oblon, McClelland, Maier & Neustadt, L.L.P.

(57) ABSTRACT

The lubricating oil composition according to the present invention is one including a base oil, (A) a substituted hydroxy aromatic carboxylic acid ester derivative represented by at least one of the general formula (I) and the general formula (II), and (B) a heterocyclic compound represented by the general formula (III) or (IV) blended therein, wherein a phosphorus content is 0.06 mass % or less on the basis of a total amount of the composition, and a sulfated ash content is 1.2 mass % or less on the basis of a total amount of the composition. The lubricating oil composition is capable of maintaining high-temperature detergency and acid neutralizing properties, even when amounts of a phosphorus component-containing additive and a metallic detergent are reduced.

17 Claims, No Drawings

(56) References Cited

FOREIGN PATENT DOCUMENTS

| | | | |
|---|---|---|---|
| JP | 7-165671 | A | 6/1995 |
| JP | 8-165484 | A | 6/1996 |
| JP | 2003-292982 | A | 10/2003 |
| JP | 2009-108157 | A | 5/2009 |
| JP | 2009-227918 | A | 10/2009 |
| JP | 2009-545640 | A | 12/2009 |

OTHER PUBLICATIONS

International Search Report dated Aug. 26, 2014 for PCT/JP2014/063381 filed on May 20, 2014.

* cited by examiner

LUBRICANT COMPOSITION

TECHNICAL FIELD

The present invention relates to a lubricating oil composition and also relates to a lubricating oil composition for internal combustion engines.

BACKGROUND ART

In recent years, for the purpose of reducing environmental loads, strict regulations against exhaust gases have been successively introduced in the automotive industry, and the development of post-processing apparatuses of exhaust gases has been carried out. The exhaust gases contain, in addition to carbon dioxide ($CO_2$) as a global warming substance, harmful substances, such as particular matters (PM), hydrocarbons (HC), carbon monoxide (CO), nitrogen oxides ($NO_x$), etc. Among these substances, very strict regulation values have been imposed on PM and $NO_x$. As the measure for reducing an amount of these substances discharged, gasoline automobiles are provided with a three-way catalyst, whereas diesel automobiles are provided with a diesel particulate filter (DPF). The exhaust gases are cleaned by passing through these members, and then discharged into atmospheric air.

In recent years, it has been recently reported that the active sites of the three-way catalyst are poisoned with phosphorus components contained in a lubricating oil composition for internal combustion engines, thereby causing deterioration in a catalyst performance thereof. In addition, it has been reported that an ash originated from metallic components is deposited on the DPF, thereby reducing the service life of the DPF. For this reason, at present, in the ILSAC Standard and the JASO Standard as standards for a lubricating oil composition for internal combustion engines, the upper limits of the phosphorus content and the ash have been established, and the development of lubricating oil compositions for internal combustion engines in which the phosphorus content and the blending amount of the ash are reduced within the range of prescribed values have been advanced.

As an example of a method of reducing the ash, there is exemplified a method of reducing the amount of a metallic detergent. But, in the conventional lubricating oil compositions, the metallic detergent was essential from the viewpoint of improving the acid neutralizing properties, and hence, if the addition amount of the metallic detergent is reduced for the purpose of reducing the ash, there is a concern that detergency of the lubricating oil composition is lowered. In addition, if the addition amount of the metallic detergent is reduced, the acid neutralizing properties are lowered, and hence, there is also a concern that oxidation deterioration of the lubricating oil composition is liable to progress. On the other hand, there has been proposed a so-called ash-free detergent-dispersant as a replacement of the metallic detergent (see Patent Document 1). In addition, there has been proposed addition of a specified heterocyclic compound capable of preventing oxidation deterioration of the lubricating oil composition from occurring (see Patent Document 2).

PRIOR DOCUMENT

Patent Document

Patent Document 1: JP H07-165671A
Patent Document 2: JP2009-545640A

SUMMARY OF INVENTION

Technical Problem

However, even in the aforementioned conventional lubricating oil compositions containing an ash-free detergent-dispersant or heterocyclic compound, in order to obtain desired properties regarding the high-temperature detergency, a specific amounts of a phosphorus-based additive and a metallic detergent were required. For this reason, in order to further reduce the addition amounts of the phosphorus-based additive and the metallic detergent while maintaining at least the high-temperature detergency and acid neutralizing properties, much more improvements have been demanded.

That is, an object of the present invention is to provide a lubricating oil composition capable of maintaining high-temperature detergency and acid neutralizing properties, even when amounts of a phosphorus component-containing additive and a metallic detergent are reduced.

Solution to Problem

The present inventors made extensive and intensive investigations. As a result, it has been found that the object can be achieved by a lubricating oil composition comprising a substituted hydroxy aromatic carboxylic acid ester derivative and a specified heterocyclic compound blended therein. The present invention has been accomplished on the basis of such finding. Specifically, the present invention provides the following:

[1] A lubricating oil composition comprising a base oil, (A) a substituted hydroxy aromatic carboxylic acid ester derivative represented by at least one of the general formula (I) and the general formula (II), and (B) a heterocyclic compound represented by the general formula (III) or (IV) blended therein, wherein a phosphorus content is 0.06 mass % or less on the basis of a total amount of the composition, and a sulfated ash content is 1.2 mass % or less on the basis of a total amount of the composition.

(I)

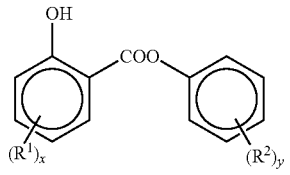

In the formula, each of x and y is an integer satisfying $1 \leq x \leq 3$ and $1 \leq y \leq 3$, respectively; each of $R^1$ and $R^2$ represents an alkyl group having 9 to 20 carbon atoms and may be the same as or different from each other; and in the case of $2 \leq x \leq 3$ and $2 \leq y \leq 3$, plural $R^1$s may be the same as or different from each other and plural $R^2$s may be the same as or different from each other.

(II)

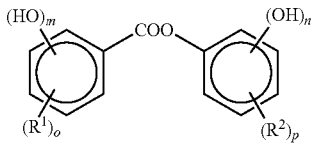

In the formula, each of m, n, o, and p is an integer satisfying $1 \leq m \leq 2$, $0 \leq n \leq 2$, $2 \leq (m+n) \leq 4$, $1 \leq o \leq 3$, and $1 \leq p \leq 3$, respectively; each of $R^1$ and $R^2$ represents an alkyl group having 9 to 20 carbon atoms and may be the same as or different from each other; and in the case of $2 \leq o \leq 3$ and $2 \leq p \leq 3$, plural $R^1$s may be the same as or different from each other and plural $R^2$s may be the same as or different from each other.

(III)

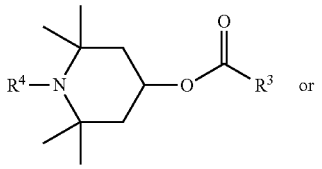

or (IV)

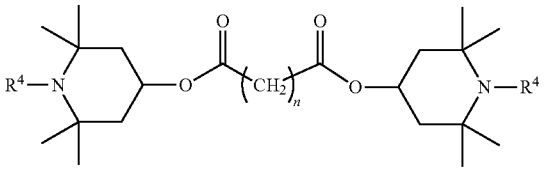

In the formulae, $R^3$ represents a linear or branched alkyl group having 7 to 17 carbon atoms; n is 6 to 18; in the case where a plurality of $R^4$s are present, each $R^4$ is independently a group selected from a hydrogen atom, an alkyl group having 1 to 18 carbon atoms, a —$COR^5$ group, and an —$OR^6$ group; $R^5$ is an alkyl group having 1 to 17 carbon atoms; and $R^6$ is an alkyl group having 1 to 18 carbon atoms.

[2] The lubricating oil composition as set forth in the above item [1], wherein, in the lubricating oil composition, the phosphorus content is 0.06 mass % or less on the basis of a total amount of the composition, and the sulfated ash content is 0.5 mass % or less on the basis of a total amount of the composition.

[3] The lubricating oil composition as set forth in the above item [1], wherein, in the lubricating oil composition, the phosphorus content is 0.06 mass % or less on the basis of a total amount of the composition, and the sulfated ash content is 0.3 mass % or less on the basis of a total amount of the composition.

[4] The lubricating oil composition as set forth in the above item [1], wherein, in the lubricating oil composition, the phosphorus content is 0.03 mass % or less, and the sulfated ash content is 0.5 mass % or less on the basis of a total amount of the composition.

[5] The lubricating oil composition as set forth in the above item [1], wherein, in the lubricating oil composition, the phosphorus content is 0.03 mass % or less, and the sulfated ash content is 0.3 mass % or less on the basis of a total amount of the composition.

[6] The lubricating oil composition as set forth in any one of the above items [1] to [5], further comprising at least one of an antioxidant and a dispersant blended therein.

[7] The lubricating oil composition as set forth in any one of the above items [1] to [6], which is used for lubrication of internal combustion engines.

In addition, the present invention provides the lubricating oil composition as set forth in any one of the above items [1] to [6], wherein, in the general formula (III) or (IV), $R^4$ is a hydrogen atom or a methyl group, or the lubricating oil composition as set forth in any one of the above items [1] to [6], wherein, in the general formula (III) or (IV), $R^4$ is a hydrogen atom.

Furthermore, the present invention provides a lubricating oil composition containing a base oil, (A) a substituted hydroxy aromatic carboxylic acid ester derivative represented by at least one of the general formula (I) and the general formula (II), and (B) a heterocyclic compound represented by the general formula (III) or (IV), wherein a phosphorus content is 0.06 mass % or less on the basis of a total amount of the composition, and a sulfated ash content is 1.2 mass % or less on the basis of a total amount of the composition.

Moreover, the present invention provides a method for producing a lubricating oil composition, which includes blending a base oil, (A) a substituted hydroxy aromatic carboxylic acid ester derivative represented by at least one of the general formula (I) and the general formula (II), and (B) a heterocyclic compound represented by the general formula (III) or (IV), thereby producing a lubricating oil composition having a phosphorus content of 0.06 mass % or less on the basis of a total amount of the composition and a sulfated ash content of 1.2 mass % or less on the basis of a total amount of the composition.

Advantageous Effects of Invention

According to the present invention, it is possible to provide a lubricating oil composition capable of maintaining high-temperature detergency and acid neutralizing properties, even when amounts of a phosphorus component-containing additive and a metallic detergent are reduced.

DESCRIPTION OF EMBODIMENTS

[Lubricating Oil Composition]

A lubricating oil composition according to an embodiment of the present invention includes a base oil, (A) a substituted hydroxy aromatic carboxylic acid ester derivative represented by at least one of the general formula (I) and the general formula (II), and (B) a heterocyclic compound represented by the general formula (III) or (IV) blended therein, wherein a phosphorus content is 0.06 mass % or less on the basis of a total amount of the composition, and a sulfated ash content is 1.2 mass % or less on the basis of a total amount of the composition.

(I)

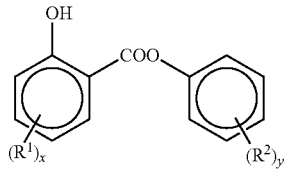

In the formula, each of x and y is an integer satisfying $1 \leq x \leq 3$ and $1 \leq y \leq 3$, respectively; each of $R^1$ and $R^2$ represents an alkyl group having 9 to 20 carbon atoms and may be the same as or different from each other; and in the case of $2 \leq x \leq 3$ and $2 \leq y \leq 3$, plural $R^1$s may be the same as or different from each other and plural $R^2$s may be the same as or different from each other.

(II)

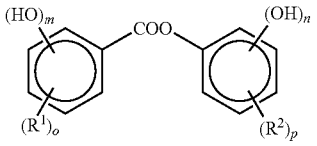

In the formula, each of m, n, o, and p is an integer satisfying $1 \leq m \leq 2$, $0 \leq n \leq 2$, $2 \leq (m+n) \leq 4$, $1 \leq o \leq 3$, and $1 \leq p \leq 3$, respectively; each of $R^1$ and $R^2$ represents an alkyl group having 9 to 20 carbon atoms and may be the same as or different from each other; and in the case of $2 \leq o \leq 3$ and $2 \leq p \leq 3$, plural $R^1$s may be the same as or different from each other and plural $R^2$s may be the same as or different from each other.

(III)

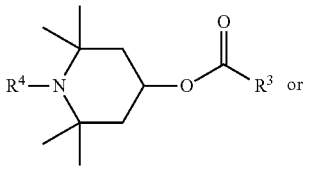

(IV)

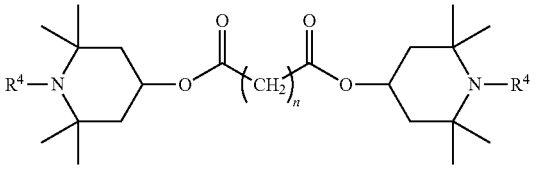

In the formulae, $R^3$ represents a linear or branched alkyl group having 7 to 17 carbon atoms; n is 6 to 18; in the case where a plurality of $R^4$s are present, each $R^4$ is independently a group selected from a hydrogen atom, an alkyl group having 1 to 18 carbon atoms, a —$COR^5$ group, and an —$OR^6$ group; $R^5$ is an alkyl group having 1 to 17 carbon atoms; and $R^6$ is an alkyl group having 1 to 18 carbon atoms.

It should be noted that in the present embodiment, the lubricating oil composition containing a base oil, (A) a substituted hydroxy aromatic carboxylic acid ester derivative represented by at least one of the general formula (I) and the general formula (II), and (B) a heterocyclic compound represented by the general formula (III) or (IV) blended therein is one generally containing those blended compounds. In addition, at least a part of the compounds contained in the lubricating oil composition may be converted to a different compound upon reaction.

Each of the aforementioned elements is hereunder described.

[Base Oil]

As the base oil which is used in the present invention, any arbitrary oils including mineral oils and synthetic oils which have hitherto been used as abase oil of lubricating oils may be properly selected and used.

The type of the mineral oil and the synthetic oil is not specifically limited, and for use herein, any one may be suitably selected from the group consisting of a mineral oil and a synthetic oil heretofore used as the base oil in lubricating oil.

Examples of the mineral oil include a mineral oil refined by subjecting a lubricating oil distillate that is obtained by distilling under a reduced pressure the atmospheric residue given by atmospheric distillation of crude oil, to one or more treatments selected from the group consisting of solvent deasphalting, solvent extraction, hydro-cracking, solvent dewaxing, catalytic dewaxing, hydrorefining and the like, and a mineral oil produced by isomerization of wax or GTL WAX and the like.

Meanwhile, examples of the synthetic oil include polybutene, polyolefins [α-olefin homopolymers and copolymers (e.g., ethylene-α-olefin copolymers)], various kinds of esters (for example, polyol esters, dibasic acid esters, phosphate esters), various kinds of ethers (for example, polyphenyl ethers), polyglycols, alkylbenzenes, alkylnaphthalenes, etc. Among those synthetic oils, polyolefins and polyol esters are particularly preferred.

In the present invention, as for the base oil, the aforementioned mineral oils may be used alone or in combinations of two or more thereof. In addition, the aforementioned synthetic oils may be used alone or in combinations of two or more thereof. Furthermore, one or more members of the mineral oils and one or more members of the synthetic oils may be used in combination.

A kinematic viscosity at 100° C. of the base oil is preferably in the range of 1.5 $mm^2/s$ or more and 30 $mm^2/s$ or less, more preferably in the range of 3 $mm^2/s$ or more and 30 $mm^2/s$ or less, and still more preferably in the range of 3 $mm^2/s$ or more and 15 $mm^2/s$ or less. So long as the kinematic viscosity at 100° C. is 1.5 $mm^2/s$ or more, a vaporization loss is suppressed, whereas so long as it is 30 $mm^2/s$ or less, a power loss attributable to viscous resistance is suppressed, so that a fuel consumption improvement effect is obtained.

In addition, as for the base oil, a base oil having a % $C_A$ by ring analysis of 3.0 or less and a sulfur content of 50 ppm by mass or less is preferably used. Here, the "% $C_A$ by ring analysis" refers to an aromatic content (percentage) calculated by the ring analysis n-d-M method. In addition, the sulfur content is a value measured in conformity with JIS K2541.

The base oil having a % $C_A$ of 3.0 or less and a sulfur content of 50 ppm by mass or less can provide a lubricating oil composition having favorable oxidation stability and capable of suppressing an increase in acid number or sludge formation. The % $C_A$ is more preferably 1.0 or less, and still more preferably 0.5 or less; and the sulfur content is more preferably 30 ppm by mass or less.

Furthermore, a viscosity index of the base oil is preferably 70 or more, more preferably 100 or more, and still more preferably 120 or more. The base oil having a viscosity index of 70 or more is suppressed in terms of a variation in viscosity to be caused due to a change of temperature. A pour point that is an index of low-temperature fluidity of this base oil is preferably −10° C. or lower.

[(A) Substituted Hydroxy Aromatic Carboxylic Acid Ester Derivative]

The substituted hydroxy aromatic carboxylic acid ester derivative which is used in the present invention is represented by the following general formula (I) or (II).

(I)

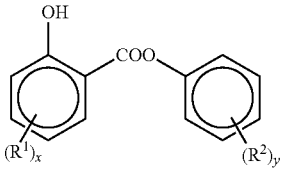

In the formula, each of x and y is an integer satisfying $1 \leq x \leq 3$ and $1 \leq y \leq 3$, respectively; each of $R^1$ and $R^2$ represents an alkyl group having 9 to 20 carbon atoms and may be the same as or different from each other; and in the case of $2 \leq x \leq 3$ and $2 \leq y \leq 3$, plural $R^1$s may be the same as or different from each other and plural $R^2$s may be the same as or different from each other.

(II)

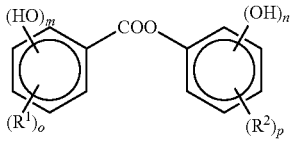

In the formula, each of m, n, o, and p is an integer satisfying $1 \leq m \leq 2$, $0 \leq n \leq 2$, $2 \leq (m+n) \leq 4$, $1 \leq o \leq 3$, and $1 \leq p \leq 3$, respectively; each of $R^1$ and $R^2$ represents an alkyl group having 9 to 20 carbon atoms and may be the same as or different from each other; and in the case of $2 \leq o \leq 3$ and $2 \leq p \leq 3$, plural $R^1$s may be the same as or different from each other and plural $R^2$s may be the same as or different from each other. More preferably, plural $R^1$s are the same and plural $R^2$s are the same.

In the foregoing general formulae (I) and (II), examples of the alkyl group having 9 to 20 carbon atoms may include hydrocarbon groups, such as a nonyl group, a decyl group, a dodecyl group, a hexadecyl group, an octadecyl group, an eicosyl group, etc.; groups derived from olefin polymers (for example, polyethylene, polypropylene, polybutene, etc.); and the like. The alkyl group having 9 to 20 carbon atoms may be any of a linear hydrocarbon group and a branched hydrocarbon group. In the case where a low-viscosity carboxylic acid ester derivative is desired, it is preferred that $R^1$ and $R^2$ are each actually a linear hydrocarbon group. In addition, $R^1$ and $R^2$ are each preferably an alkyl group having 9 to 18 carbon atoms.

Specific examples of the substituted hydroxy aromatic carboxylic acid ester derivative represented by the foregoing general formula (I) include (hexadecylsalicylic acid) hexadecylphenyl ester, (tetradecylsalicylic acid) tetradecylphenyl ester, (dodecylsalicylic acid) dodecylphenyl ester, (decylsalicyclic acid) decylphenyl ester, (nonylsalicyclic acid) nonylphenyl ester, (hexadecylsalicylic acid) nonylphenyl ester, a (mixed $C_{11}$ to $C_{15}$)alkylsalicylic acid (mixed $C_{11}$ to $C_{15}$)alkylphenyl ester, a (mixed $C_{11}$ to $C_{15}$)alkylsalicylic acid hexadecylphenyl ester, a (mixed $C_{11}$ to $C_{15}$)alkylsalicylic acid dodecylphenyl ester, a (mixed $C_{11}$ to $C_{15}$)alkylsalicylic acid decylphenyl ester, a (mixed $C_{11}$ to $C_{15}$)alkylsalicylic acid nonylphenyl ester, and the like.

Specific examples of the substituted hydroxy aromatic carboxylic acid ester derivative represented by the foregoing general formula (II) include (hexadecylsalicylic acid) hexadecylhydroxylphenyl ester, (tetradecylsalicylic acid) tetradecylhydroxyphenyl ester, (dodecylsalicylic acid) dodecylhydroxyphenyl ester, (decylsalicyclic acid) decylhydroxyphenyl ester, (nonylsalicylic acid) nonylhydroxyphenyl ester, (hexadecylsalicylic acid) nonylhydroxyphenyl ester, a (mixed $C_{11}$ to $C_{15}$)alkylsalicylic acid hexadecylhydroxyphenyl ester, a (mixed $C_{11}$ to $C_{15}$) alkylsalicylic acid dodecylhydroxyphenyl ester, a (mixed $C_{11}$ to $C_{15}$)alkylsalicylic acid decylhydroxyphenyl ester, a (mixed $C_{11}$ to $C_{15}$)alkylsalicylic acid nonylhydroxyphenyl ester, (hexadecyldihydroxybenzoic acid) hexadecylphenyl ester, (tetradecyldihydroxybenzoic acid) tetradecylphenyl ester, (dodecyldihydroxybenzoic acid) dodecylphenyl ester, (decyldihydroxybenzoic acid) decylphenyl ester, (nonyldihydroxybenzoic acid) nonylphenyl ester, (hexadecyldihydroxybenzoic acid) nonylphenyl ester, a hexadecyldihydroxybenzoic acid (mixed $C_{11}$ to $C_{15}$)alkylphenyl ester, a dodecyldihydroxybenzoic acid (mixed $C_{11}$ to $C_{15}$)alkylphenyl ester, a decyldihydroxybenzoic acid (mixed $C_{11}$ to $C_{15}$) alkylphenyl ester, a nonyldihydroxybenzoic acid (mixed $C_{11}$ to $C_{15}$)alkylphenyl ester, (hexadecyldihydroxybenzoic acid) hexadecylhydroxyphenyl ester, (tetradecyldihydroxybenzoic acid) tetradecylhydroxyphenyl ester, (dodecyldihydroxybenzoic acid) dodecylhydroxyphenyl ester, (decyldihydroxybenzoic acid) decylhydroxyphenyl ester, (nonyldihydroxybenzoic acid) nonylhydroxyphenyl ester, (hexadecyldihydroxybenzoic acid) nonylhydroxyphenyl ester, a hexadecyldihydroxybenzoic acid (mixed $C_{11}$ to $C_{15}$) alkylhydroxyphenyl ester, a dodecyldihydroxybenzoic acid (mixed $C_{11}$ to $C_{15}$)alkylhydroxyphenyl ester, a decyldihydroxybenzoic acid (mixed $C_{11}$ to $C_{15}$)alkylhydroxyphenyl ester, a nonyldihydroxybenzoic acid (mixed $C_{11}$ to $C_{15}$) alkylhydroxyphenyl ester, and the like.

It is preferred to use (hexadecylsalicylic acid) hexadecylphenyl ester as the substituted hydroxy aromatic carboxylic acid ester derivative represented by at least one of the foregoing general formula (I) and the foregoing general formula (II).

In addition, in the lubricating oil composition of the present invention, the substituted hydroxy aromatic carboxylic acid ester derivative (A) may be a mixture of plural carboxylic acid ester derivatives. In the case of using a mixture of plural carboxylic acid ester derivatives, it is preferred that the substituted hydroxy aromatic carboxylic acid ester derivative represented by the general formula (I) or (II) is contained in an amount of 60% or more on the basis of a total amount of the mixture of plural carboxylic acid ester derivatives.

In addition, the amount of the substituted hydroxy aromatic carboxylic acid ester derivative represented by the general formula (I) or (II) is more preferably 65% or more and 100% or less on the basis of a total amount of the mixture of plural carboxylic acid ester derivatives.

The amount of the substituted hydroxy aromatic carboxylic acid ester derivative represented by the general formula (I) or (II) is still more preferably 70% or more and 100% or less on the basis of a total amount of the mixture of plural carboxylic acid ester derivatives.

The substituted hydroxy aromatic carboxylic acid ester derivative represented by each of the general formulae (I) and (II) is useful as an ash-free detergent, and furthermore, when it is used in combination of an ash-free detergent-dispersant, a lubricating oil composition having excellent high-temperature stability and high-temperature detergency and having a microparticle dispersing action can be formed.

In the lubricating oil composition of the present invention, the substituted hydroxy aromatic carboxylic acid ester derivative (A) is blended in an amount of preferably 0.01 mass % or more and 10 mass % or less, more preferably 0.1 mass % or more and 8 mass % or less, still more preferably 1 mass % or more and 7 mass % or less, and especially preferably 2 mass % or more and 6 mass % or less on the basis of a total amount of the composition.

[(B) Heterocyclic Compound]

The heterocyclic compound which is used in the present invention is represented by the following general formula (III) or (IV).

(III)

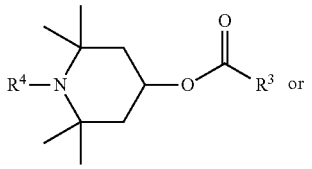

(IV)

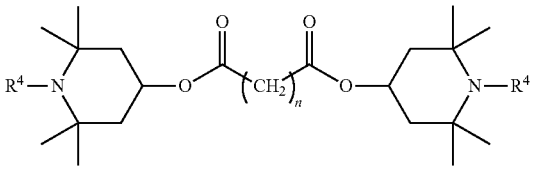

In the formulae, $R^3$ represents a linear or branched alkyl group having 7 to 17 carbon atoms; and n is 6 to 18. The alkyl group is constituted of, for example, 7, 8, 9, 10, 11, 12, 13, 14, 15, 16, or 17 carbon atoms. n is preferably 6, 8, 10, 12, 14, 16, or 18.

In the case where a plurality of $R^4$s are present, each $R^4$ is independently a group selected from a hydrogen atom, an alkyl group having 1 to 18 carbon atoms, a —$COR^5$ group, and an —$OR^6$ group; $R^5$ is an alkyl group having 1 to 17 carbon atoms; and $R^6$ is an alkyl group having 1 to 18 carbon atoms.

In the general formula (III) or (IV), $R^4$ is preferably a hydrogen atom or a methyl group, and $R^4$ is more preferably a hydrogen atom. That is, the general formula of the more preferred heterocyclic compound (B) is as follows.

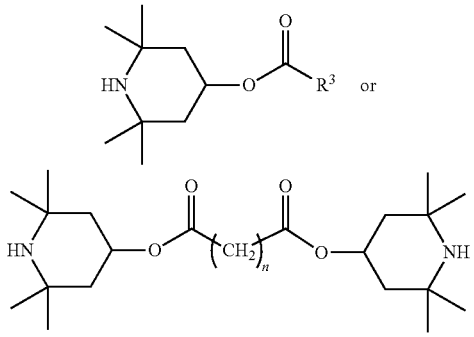

The heterocyclic compound may be produced by a well-known method. As for the heterocyclic compound (B), a hindered amine represented by the following formula is preferred as the compound represented by the general formula (IV) wherein $R^4$ is a methyl group.

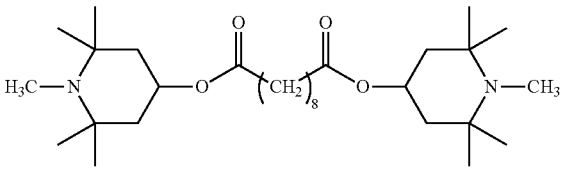

In addition, a hindered amine represented by the following formula is preferred as the compound represented by the general formula (III) or (IV) wherein $R^4$ is a hydrogen atom.

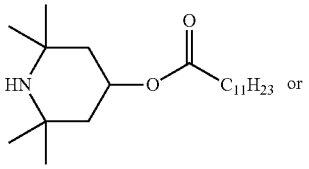

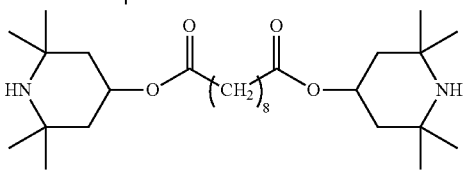

In the lubricating oil composition of the present invention, the heterocyclic compound (B) is blended in an amount of preferably 0.01 mass % or more and 5 mass % or less, more preferably 0.05 mass % or more and 3 mass % or less, and still more preferably 0.1 mass % or more and 2 mass % or less on the basis of a total amount of the composition.

[Phosphorus Content and Sulfated Ash Content of Lubricating Oil Composition]

The lubricating oil composition of the present invention has the aforementioned constitution, and the phosphorus content and the sulfated ash content on the basis of a total amount of the composition are required such that the phosphorus content is 0.06 mass % or less on the basis of a total amount of the composition; and that the sulfated ash content is 1.2 mass % or less on the basis of a total amount of the composition.

When the phosphorus content in the composition is more than 0.06 mass % on the basis of a total amount of the composition, a poisoning action of active sites of a three-way catalyst cannot be suppressed, and an effect for prolonging the catalyst service life is not obtained. In addition, when the sulfated ash content is more than 1.2 mass % on the basis of a total amount of the composition, an ash originated from metallic components is liable to deposit on DPF, and an effect for prolonging the service life of the DPF is not obtained.

It should be noted that the phosphorus content is based on JIS-5S-38-92; and that the sulfated ash content is based on JIS K2272.

So long as the phosphorus content in the lubricating oil composition is 0.06 mass % or less on the basis of a total amount of the composition, and the sulfated ash content is 0.5 mass % or less on the basis of a total amount of the composition, a poisoning action of active sites of a three-way catalyst can be suppressed, and the catalyst service life can be prolonged. In addition, detergency required as the lubricating oil composition for internal combustion engines is obtained, deposition of an ash originated from metallic components on DPF can be suppressed, and an effect for prolonging the service life of the DPF is obtained.

Furthermore, so long as the phosphorus content in the lubricating oil composition is 0.06 mass % or less on the basis of a total amount of the composition, and the sulfated ash content is 0.3 mass % or less on the basis of a total amount of the composition, a poisoning action of active sites of a three-way catalyst can be suppressed, and the catalyst service life can be prolonged. In addition, high detergency as the lubricating oil composition for internal combustion engines is obtained, deposition of an ash originated from metallic components on DPF can be more suppressed, and the service life of the DPF can be more prolonged.

Furthermore, so long as the phosphorus content in the lubricating oil composition is 0.03 mass % or less, and the sulfated ash content is 0.5 mass % or less on the basis of a total amount of the composition, a poisoning action of active sites of a three-way catalyst can be sufficiently suppressed, and the catalyst service life can be more prolonged. In addition, detergency required as the lubricating oil composition for internal combustion engines is obtained, deposition of an ash originated from metallic components on DPF can be suppressed, and an effect for prolonging the service life of the DPF is obtained.

Moreover, so long as the phosphorus content in the lubricating oil composition is 0.03 mass % or less on the basis of a total amount of the composition, and the sulfated ash content is 0.3 mass % or less on the basis of a total amount of the composition, a poisoning action of active sites of a three-way catalyst can be sufficiently suppressed, and the catalyst service life can be more prolonged. In addition, high detergency as the lubricating oil composition for internal combustion engines is obtained, deposition of an ash originated from metallic components on DPF can be more suppressed, and the service life of the DPF can be more prolonged.

The phosphorus content can be adjusted by a blending amount of a phosphorus-based anti-wear agent. Typical examples of the phosphorus-based anti-wear agent include phosphoric acid ester-based compounds and thiophosphoric acid ester-based compounds. Above all, phosphorous acid esters, alkyl hydrogenphosphites, phosphoric acid ester amine salts, and the like are preferred. In the present invention, zinc dithiophosphate (ZnDTP) is especially preferred.

[Additives]

The lubricating oil composition of the present invention may be blended with conventionally known additives so long as the effects thereof are not impaired. Examples of the additive include a dispersant, an antioxidant, a metallic detergent, a viscosity index improver, a pour point depressant, an anti-wear agent, an extreme pressure agent, a metal deactivator, a rust preventive, a defoaming agent, and the like. It is preferred that the lubricating oil composition of the present invention contains at least one of an antioxidant and a dispersant.

<Dispersant>

As for the dispersant, a metal-free ash-free dispersant is preferably used. As the ash-free dispersant, a boronated imide-based dispersant, and optionally, a non-boronated imide-based dispersant may be used. The non-boronated imide-based dispersant is one generally called an imide-based dispersant. As for the imide-based dispersant, a polybutenylsuccinimide is suitably used. Examples of the polybutenylsuccinimide include compounds represented by the following formulae (1) and (2).

(1)

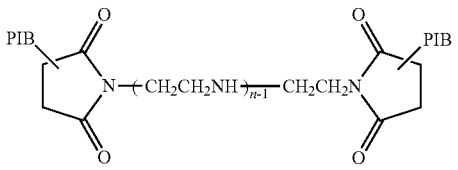

-continued (2)

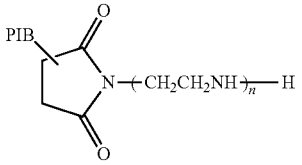

In these general formulae (1) and (2), PIB represents a polybutenyl group, and its number average molecular weight is typically 900 or more and 3,500 or less, and preferably 1,000 or more and 2,000 or less. So long as the number average molecular weight is 900 or more, there is no concern that the dispersibility is deteriorated, whereas so long as it is 3,500 or less, there is no concern that the storage stability is deteriorated. In addition, in the above general formulae (1) and (2), n is typically an integer of 1 to 5, and more preferably an integer of 2 to 4.

A method of producing the aforementioned polybutenylsuccinimide is not particularly limited, and the polybutenyl succinic acid imide may be produced by a known method. For example, the polybutenyl succinic acid imide may be obtained by allowing polybutenyl succinic acid which is obtained through reaction of polybutene with maleic anhydride at 100° C. or higher and 200° C. or lower, to react with a polyamine, such as diethylenetriamine, triethylenetetramine, tetraethylenepentamine, pentaethylenehexamine, etc.

As for the boronated imide-based dispersant, it is preferred to use a boronated polybutenylsuccinimide obtained by allowing a boron compound to act on the non-boronated imide-based dispersant exemplified by the foregoing general formula (1) or (2).

Examples of the boron compound include boric acid, a boric acid salt, a boric acid ester, and the like. Examples of the boric acid include orthoboric acid, metaboric acid, paraboric acid, and the like. In addition, suitable examples of the boric acid salt include ammonium salts and the like, for example, ammonium borates, such as ammonium metaborate, ammonium tetraborate, ammonium pentaborate, ammonium octaborate, etc. In addition, suitable examples of the boric acid ester include esters between boric acid and an alkyl alcohol (desirably having 1 to 6 carbon atoms), for example, monomethyl borate, dimethyl borate, trimethyl borate, monoethyl borate, diethyl borate, triethyl borate, monopropyl borate, dipropyl borate, tripropyl borate, monobutyl borate, dibutyl borate, tributyl borate, etc.

It should be noted that in general, a mass ratio of a boron content B and a nitrogen content N, B/N, of the boronated polybutenylsuccinimide is preferably 0.1 to 3, and more preferably 0.2 to 1.

In the lubricating oil composition for internal combustion engines which is used in the present invention, a content of each of the boronated succinimide-based dispersant and the non-borated succinimide-based dispersant (imide-based dispersant) is preferably 0.1 mass % or more and 15 mass % or less, and more preferably 0.5 mass % or more and 10 mass % or less. So long as the subject content is 0.1 mass % or more, favorable detergency and dispersibility are obtained, whereas so long as it is 15 mass % or less, effects of detergency and dispersibility commensurate with the content are obtained.

<Antioxidant>

The antioxidant is preferably a phosphorus-free antioxidant. Examples thereof include a phenol-based antioxidant, an amine-based antioxidant, a molybdenum-amine complex-based antioxidant, a sulfur-based antioxidant, and the like.

Examples of the phenol-based antioxidant include 4,4'-methylene bis(2,6-di-t-butylphenol), 4,4'-bis(2,6-di-t-butylphenol), 4,4'-bis(2-methyl-6-t-butylphenol), 2,2'-methylene bis(4-ethyl-6-t-butylphenol), 2,2'-methylene bis(4-methyl-6-t-butylphenol), 4,4'-butylidene bis(3-methyl-6-t-butylphenol), 4,4'-isopropylidene bis(2,6-di-t-butylphenol), 2,2'-methylene bis(4-methyl-6-nonylphenol), 2,2'-isobutylidene bis(4,6-dimethylphenol), 2,2'-methylene bis(4-methyl-6-cyclohexylphenol), 2,6-di-t-butyl-4-methylphenol, 2,6-di-t-butyl-4-ethylphenol, 2,4-dimethyl-6-t-butylphenol, 2,6-di-t-amyl-p-cresol, 2,6-di-t-butyl-4-(N,N'-dimethylaminomethylphenol), 4,4'-thiobis(2-methyl-6-t-butylphenol), 4,4'-thiobis(3-methyl-6-t-butylphenol), 2,2'-thiobis(4-methyl-6-t-butylphenol), bis(3-methyl-4-hydroxy-5-t-butylbenzyl) sulfide, bis(3,5-di-t-butyl-4-hydroxybenzyl) sulfide, n-octyl-3-(4-hydroxy-3,5-di-t-butylphenyl) propionate, n-octadecyl-3-(4-hydroxy-3,5-di-t-butylphenyl) propionate, 2,2'-thio[diethyl-bis-3-(3,5-di-t-butyl-4-hydroxyphenyl) propionate], and the like.

Of these, bisphenol-based antioxidants and ester group-containing phenol-based antioxidants are especially suitable.

Examples of the amine-based antioxidant include monoalkyldiphenylamine-based antioxidants, such as monooctyldiphenylamine, monononyldiphenylamine, etc.; dialkyldiphenylamine-based antioxidants, such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, 4,4'-dinonyldiphenylamine, etc.; polyalkyldiphenylamine-based antioxidants, such as tetrabutyldiphenylamine, tetrahexyldiphenylamine, tetraoctyldiphenylamine, tetranonyldiphenylamine, etc.; α-naphthylamine; phenyl-α-naphthylamine; alkyl-substituted phenyl-α-naphthylamines, such as butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine, etc.; and the like.

Of these, dialkyldiphenylamine-based antioxidants and naphthylamine-based antioxidants are suitable.

As for the molybdenum-amine complex-based antioxidant, a complex formed through reaction of a hexavalent molybdenum compound, specifically, molybdenum trioxide and/or molybdic acid, with an amine compound, for example, a compound produced by the production method described in JP 2003-252887A, may be used.

Although the amine compound to be reacted with a hexavalent molybdenum compound is not particularly limited, specifically, examples thereof include a monoamine, a diamine, a polyamine, and an alkanolamine. More particularly there are exemplified alkylamines having an alkyl group with from 1 to 30 carbon atoms (in which the alkyl group may be linear or branched) such as methylamine, ethylamine, dimethylamine, diethylamine, methylethylamine, methylpropylamine, etc.; alkenylamines having an alkenyl group with from 2 to 30 carbon atoms (in which the alkenyl group may be linear or branched) such as ethenylamine, propenylamine, butenylamine, octenylamine, oleylamine, etc.; alkanolamines having an alkanol group with from 1 to 30 carbon atoms (in which the alkanol group may be linear or branched) such as methanolamine, ethanolamine, methanolethanolamine, methanolpropanolamine, etc.; alkylenediamines having an alkylene group with from 1 to 30 carbon atoms such as methylenediamine, ethylenediamine, propylenediamine, butylenediamine, etc.; polyamines such as diethylenetriamine, triethylenetetramine, tetraethylenepentamine, pentaethylenehexamine, etc.; compounds derived from the above of the monoamines, diamines, or polyamines by incorporating there into an alkyl group or an alkenyl group having from 8 to 20 carbon atoms, such as undecyldiethylamine, undecyldiethanolamine, dodecyldipropanolamine, oleyldiethanolamine, oleylpropylenediamine, stearyltetraethylenepentamine, etc.; heterocyclic compounds, such as imidazole; alkylene oxide adducts of those compounds; mixtures of those compounds, etc.

Also, exemplified here are sulfur-containing molybdenum complexes with succinimide and the like described in JP H03-22438B and JP 2004-2866A. Specifically, these complexes may be produced through the following steps (m) and (n).

(m) A step of reacting an acidic molybdenum compound or a salt thereof with a basic nitrogen compound selected from the group consisting of succinimide, a carboxylic acid amide, a hydrocarbyl monoamine, a hydrocarbyl polyamine, a Mannich base, a phosphonic acid amide, a thiophosphonic acid amide, a phosphoric acid amide, a dispersant-type viscosity index improver, and a mixture thereof, while maintaining a reaction temperature at about 120° C. or lower, thereby forming a molybdenum complex; and (n) A step of subjecting the product of the step (m) to a stripping or sulfurization step of at least one time, or to the both steps, wherein the stripping step and/or the sulfurization step is carried out for a sufficient period of time in such a manner that when the molybdenum complex is diluted with isooctane and measured by a UV-visible spectrophotometer with a quartz cell having an optical path length of 1 cm at a fixed molybdenum concentration of 0.00025 g of molybdenum per gram of the diluted molybdenum complex, a molybdenum complex having an absorbance of less than 0.7 at a wavelength of 350 nm is given, and the reaction mixture is maintained at about 120° C. or lower during the stripping step and sulfurization step.

In addition, this molybdenum complex may also be produced through the following steps (o), (p), and (q).

(o) A step of reacting an acidic molybdenum compound or a salt thereof with a basic nitrogen compound selected from the group consisting of succinimide, a carboxylic acid amide, a hydrocarbyl monoamine, a hydrocarbyl polyamine, a Mannich base, a phosphonic acid amide, a thiophosphonic acid amide, a phosphoric acid amide, a dispersant-type viscosity index improver, and a mixture thereof, while maintaining a reaction temperature at about 120° C. or lower, thereby forming a molybdenum complex;

(p) A step of subjecting the product of the step (o) to stripping at a temperature of about 120° C. or lower; and (q) A step of sulfuring the resulting product at a temperature of about 120° C. or lower in a molar ratio of sulfur and molybdenum of about 1:1 or lower, wherein the sulfurization step is carried out for a sufficient period of time in such a manner that when the molybdenum complex is diluted with isooctane and measured by a UV-visible spectrophotometer with a quartz cell having an optical path length of 1 cm at a fixed molybdenum concentration of 0.00025 g of molybdenum per gram of the diluted molybdenum complex, a molybdenum complex having an absorbance of less than 0.7 at a wavelength of 350 nm is given.

Examples of the sulfur-based antioxidant include phenothiazine, pentaerythritol-tetrakis-(3-laurylthiopropionate), didodecyl sulfide, dioctadecyl sulfide, didodecyl thiodipropionate, dioctadecyl thiodipropionate, dimyristyl thiodipropionate, dodecyloctadecyl thiodipropionate, 2-mercaptobenzoimidazole, and the like.

Of these antioxidants, phenol-based antioxidants and amine-based antioxidants are preferred from the viewpoint of reducing metallic components or sulfur components. In addition, the aforementioned antioxidants may be used alone or in admixture of two or more thereof. From the viewpoint of an effect of oxidation stability, a mixture of one or more phenol-based antioxidant and one or more amine-based antioxidants is preferred.

In general, a blending amount of the antioxidant is preferably in the range of 0.1 mass % or more and 5 mass % or less, and more preferably in the range of 0.1 mass % or more and 3 mass % or less on the basis of a total amount of the composition. In addition, a blending amount, as reduced to the molybdenum content, of the molybdenum complex is preferably 10 ppm by mass or more and 1,000 ppm by mass or less, more preferably 30 ppm by mass or more and 800 ppm by mass or less, and still more preferably 50 ppm by mass or more and 500 ppm by mass or less on the basis of a total amount of the composition.

<Metallic Detergent>

As for the metallic detergent, an arbitrary alkaline earth metal-based detergent which is used for lubricating oils may be used, and examples thereof include an alkaline earth metal sulfonate, an alkaline earth metal phenate, an alkaline earth metal salicylate, a mixture of two or more selected among these members, and the like.

Examples of the alkaline earth metal sulfonate include alkaline earth metal salts of an alkyl aromatic sulfonic acid, which are obtained through sulfonation of an alkyl aromatic compound having a molecular weight of 300 or more and 1,500 or less, and preferably 400 or more and 700 or less, particularly magnesium salts and/or calcium salts thereof, or the like. Above all, calcium salts are preferably used.

Examples of the alkaline earth metal phenate include alkaline earth metal salts of an alkylphenol, an alkylphenol sulfide, or a Mannich reaction product of an alkylphenol, particularly magnesium salts and/or calcium salts thereof, or the like. Above all, calcium salts are especially preferably used.

Examples of the alkaline earth metal salicylate include alkaline earth metal salts of an alkylsalicylic acid, particularly magnesium salts and/or calcium salts thereof, or the like. Above all, calcium salts are preferably used.

The alkyl group constituting the alkaline earth metal-based detergent is an alkyl group having preferably 4 to 30 carbon atoms, and more preferably 6 to 18 carbon atoms. Such an alkyl group may be linear or branched. The alkyl group may be a primary alkyl group, a secondary alkyl group, or a tertiary alkyl group.

In addition, the alkaline earth metal sulfonate, alkaline earth metal phenate, and alkaline earth metal salicylate include a neutral alkaline earth metal sulfonate, a neutral alkaline earth metal phenate, and a neutral alkaline earth metal salicylate, which are obtained by reacting the aforementioned alkyl aromatic sulfonic acid, alkylphenol, alkylphenol sulfide, Mannich reaction product of an alkylphenol, or alkylsalicylic acid, or the like directly with an alkaline earth metal oxide or an alkaline earth metal base, such as a hydroxide thereof, etc., the alkaline earth metal being magnesium and/or calcium, or once converting the alkyl aromatic sulfonic acid, alkylphenol, alkylphenol sulfide, Mannich reaction product of an alkylphenol, alkylsalicylic acid, or the like to an alkali metal salt, such as a sodium salt, a potassium salt, etc., followed by substitution with an alkaline earth metal salt. Furthermore, the alkaline earth metal sulfonate, alkaline earth metal phenate, and alkaline earth metal salicylate also include a basic alkaline earth metal sulfonate, a basic alkaline earth metal phenate, and a basic alkaline earth metal salicylate, which are produced by heating the neutral alkaline earth metal sulfonate, neutral alkaline earth metal phenate, and neutral alkaline earth metal salicylate, with an excessive of an alkaline earth metal salt or an alkaline earth metal base in the presence of water; and a overbased alkaline earth metal sulfonate, a overbased alkaline earth metal phenate, and a overbased alkaline earth metal salicylate, which are obtained by reacting the neutral alkaline earth metal sulfonate, neutral alkaline earth metal phenate, and neutral alkaline earth metal salicylate with an alkaline earth metal carbonate or borate in the presence of carbon dioxide.

For the purpose of reducing the sulfur component in the composition, the metallic detergent which is used in the present invention is preferably an alkaline earth metal salicylate or an alkaline earth metal phenate. Above all, a overbased salicylate and a overbased phenate are preferred, with overbased calcium phenate being especially preferred.

The metallic detergent which is used in the present invention has a total base number of preferably in the range of 10 mgKOH/g or more and 500 mgKOH/g or less, and more preferably in the range of 15 mgKOH/g or more and 450 mgKOH/g or less. The metallic detergent may be used alone or in combination of two or more thereof.

It should be noted that the total base number as referred to herein means the total base number according to potentiometric titration (base number-perchloric acid method) to be measured according to 7. "Petroleum Product And Lubricants—Neutralization Number Test Method" in JIS K 2501.

In addition, though a metal ratio of the metallic detergent which is used in the present invention is not particularly limited, in general, one or more metallic detergents having a metal ratio of 20 or less may be used. It is especially desirable that a metallic detergent having a metal ratio of 3 or less, more preferably 1.5 or less, even more preferably 1.2 or less is used as the essential component from the viewpoint of being more excellent in oxidation stability, base number retention and high-temperature detergency and the like. The metal ratio as referred to herein is represented by (number of valences of metal element in metallic detergent)×(metal element content (mol %))/(soap group content (mol %)). The metal element means calcium, magnesium, etc.; and the soap group means a sulfonic acid group, a phenol group, a salicylic acid group, etc.

A blending amount of the metallic detergent is preferably in the range of 0 mass % or more and 20 mass % or less, more preferably in the range of 0.01 mass % or more and 20 mass % or less, still more preferably in the range of 0.05 mass % or more and 10 mass % or less, and especially preferably in the range of 0.1 mass % or more and 5 mass % or less on the basis of a total amount of the lubricating oil composition.

So long as the blending amount of the metallic detergent is 0.01 mass % or more, performances, such as high-temperature detergency, oxidation stability, maintainability of base number, etc., are liable to be obtained. Meanwhile, so long as the blending amount is 20 mass % or less, the effects commensurate with its addition amount are generally obtained. However, as for an upper limit of the blending amount of the metallic detergent, it is important to make the blending amount low as far as possible in spite of the foregoing range. According to this, the metallic content, i.e., the sulfated ash content, of the lubricating oil composition is reduced, so that deterioration of an exhaust gas cleaner of automobiles can be prevented from occurring.

In addition, the metallic detergent may be used alone or in combination of two or more thereof so long as it is contained in the aforementioned prescribed amount.

Specifically, among the metallic detergents, overbased calcium salicylate or overbased calcium phenate is especially preferred, and among the ash-free dispersants, the aforementioned polybutenyl succinic acid bisimide is particularly preferred. It should be noted that the total base number of each of the aforementioned overbased calcium salicylate and overbased calcium phenate is preferably in the range of 100 mgKOH/g or more and 500 mgKOH/g or less, and more preferably in the range of 200 mgKOH/g or more and 500 mgKOH/g or less.

<Viscosity Index Improver>

The viscosity index improver includes, for example, polymethacrylates, dispersant-type polymethacrylates, olefinic copolymers (for example, ethylene-propylene copolymers), dispersant-type olefinic copolymers, styrenic copolymers (for example, styrene-diene copolymers, styrene-isoprene copolymers), etc. The blending amount of the viscosity index improver may be from 0.5% by mass to 15% by mass, preferably from 1% by mass to 10% by mass based on the total amount of the composition, from the viewpoint of the blending effect.

<Pour-Point Depressant>

The pour point depressant includes, for example, polymethacrylates having a mass average molecular weight of about 5,000 or more and about 50,000 or less, and the like. A blending amount of the pour point depressant is preferably in the range of 0.1 mass % or more and 2 mass % or less, and more preferably in the range of 0.1 mass % or more and 1 mass % or less on the basis of a total amount of the lubricating oil composition from the standpoint of its blending effect.

<Anti-Wear Agent or Extreme Pressure Agent>

Examples of the anti-wear agent or the extreme pressure agent include sulfur-containing compounds such as zinc dithiophosphate, zinc phosphate, zinc dithiocarbamate, molybdenum dithiocarbamate, molybdenum dithiophosphate, disulfides, olefin sulfides, sulfurized oils and fats, sulfurized esters, thiocarbonates, thiocarbamates, and polysulfides; phosphorus-containing compounds such as phosphorous acid esters, phosphoric acid esters, phosphonic acid esters, and amine salts or metal salts of those compounds; sulfur- and phosphorus-containing anti-wear agents, such as thiophosphorous acid esters, thiophosphorous acid esters, thiophosphonic acid esters, and amine salts or metal salts of those compounds.

In the case of blending an anti-wear agent or an extreme pressure agent, attention must be paid with respect to its blending amount such that when blending the anti-wearing or the extreme pressure agent, the content of the phosphorus components or metallic components in the lubricating oil does not become excessive. The blending amount of the anti-wearing or the extreme pressure agent is preferably in the range of 0 mass % or more and 3 mass % or less, and more preferably in the range of 0.01 mass % or more and 2 mass % or less on the based on the total amount of the lubricating oil composition.

<Other Additives>

The lubricating oil composition of the present invention may further contain a friction modifier, an anti-wear agent, or an extreme pressure agent in accordance with need. It should be noted that this friction modifier refers to a compound other than the polar group-containing compound that is an essential component of the present invention. A blending amount of the friction modifier is preferably in the range of 0.01 mass % or more and 2 mass % or less, and more preferably in the range of 0.01 mass % or more and 1 mass % or less on the basis of a total amount of the lubricating oil composition.

The metal deactivator includes, for example, benzotriazole compounds, tolyltriazole compounds, thiadiazole compounds, imidazole compounds, etc.

The rust inhibitor includes, for example, petroleum sulfonate, alkylbenzene sulfonates, dinonylnaphthalene sulfonates, alkenyl succinic acid esters, a polyhydric alcohol ester, etc.

The defoaming agent includes for example, silicone oil, fluorosilicone oil, fluoroalkyl ether, etc.

[Internal Combustion Engine]

The lubricating oil composition of the present invention may be preferably used as a lubricating oil for internal combustion engines, such as gasoline engines, diesel engines, gas engines, etc., for two-wheeled vehicles, four-wheeled vehicles, power generation facilities, water vehicles, etc. By virtue of low phosphorus content and low sulfated ash content, in particular, the lubricating oil composition of the present invention can be suitably used for lubrication of internal combustion engines equipped with an exhaust gas cleaner.

[Production Method of Lubricating Oil Composition]

The production method of a lubricating oil composition according to an embodiment of the present invention is a method for producing a lubricating oil composition containing blending a base oil, (A) a substituted hydroxy aromatic carboxylic acid ester derivative represented by at least one of the general formula (I) and the general formula (II), and (B) a heterocyclic compound represented by the formula (III) or (IV), thereby producing a lubricating oil composition having a phosphorus content of 0.06 mass % or less on the basis of a total amount of the composition and a sulfated ash content of 1.2 mass % or less on the basis of a total amount of the composition.

(I)

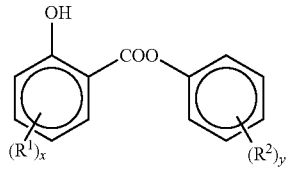

In the formula, each of x and y is an integer satisfying ($1 \leq x \leq 3$) and ($1 \leq y \leq 3$), respectively; each of $R^1$ and $R^2$ represents an alkyl group having 9 to 20 carbon atoms and may be the same as or different from each other; and in the case of ($2 \leq x \leq 3$) and ($2 \leq y \leq 3$), plural $R^1$s may be the same as or different from each other and plural $R^2$s may be the same as or different from each other.

(II)

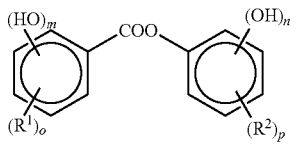

In the formula, each of m, n, o, and p is an integer satisfying ($1 \leq m \leq 2$), ($0 \leq n \leq 2$), ($2 \leq (m+n) \leq 4$), ($1 \leq o \leq 3$), and ($1 \leq p \leq 3$), respectively; each of $R^1$ and $R^2$ represents an alkyl group having 9 to 20 carbon atoms and may be the same as or different from each other; and in the case of ($2 \leq o \leq 3$) and ($2 \leq p \leq 3$), plural $R^1$s may be the same as or different from each other and plural $R^2$s may be the same as or different from each other.

(III)

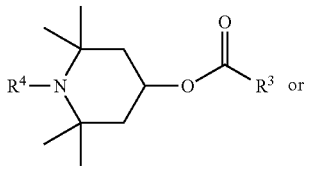

(IV)

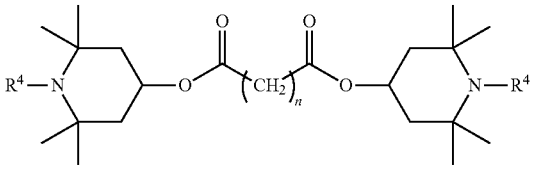

In the formulae, $R^3$ represents a linear or branched alkyl group having 7 to 17 carbon atoms; n is 6 to 18; in the case where a plurality of $R^4$s are present, each $R^4$ is independently a group selected from a hydrogen atom, an alkyl group having 1 to 18 carbon atoms, a —$COR^5$ group, and an —$OR^6$ group; $R^5$ is an alkyl group having 1 to 17 carbon atoms; and $R^6$ is an alkyl group having 1 to 18 carbon atoms.

According to the aforementioned production method, it is possible to provide a lubricating oil composition capable of maintaining high-temperature detergency and acid neutralizing properties, even when amounts of a phosphorus component-containing additive and a metallic detergent are reduced.

In the production method of a lubricating oil composition according to the present invention, the blending amounts of the component (A) and the component (B) in the base oil are those described above for the suitable contents in the lubricating oil composition.

In addition, in the production method of a lubricating oil composition according to the present invention, the aforementioned additives may be added in the suitable contents as described above, as the need arises.

Examples

The present invention will next be described in more detail by reference to Examples and Comparative Examples, but it should not be construed that the present invention is limited to these Examples.

[Evaluation Methods and Measuring Methods]

Properties and performances of lubricating oil compositions were determined through the following methods.

<Phosphorus Content>

Determined in conformity with JPI-5S-38-92.

<Sulfated Ash Content>

Determined in conformity with JIS K 2272.

<Hot Tube Test>

An oil sample and air were continuously fed to a glass tube having an inner diameter of 2 mm for 16 hours, while the tube was maintained at 280° C. The flow rate of the oil sample was adjusted to 0.3 mL/hr, and that of air to 10 mL/min. After the passage for 16 hours, a lacquer-like deposit on the inner surface of the glass tube was evaluated with reference to a color sample. When the deposit assumed transparent, it was rated as a score of 10, whereas when the deposit assumed black, it was rated as a score of 0. Also, the mass of the lacquer-like deposit on the inner surface was measured. The higher the score, or the smaller the amount of the lacquer-like deposit, the higher the performance of the oil sample.

<Residual Percentage of Base Number>

A base number of a lubricating oil composition before the hot tube test (called "new oil") and a base number of a lubricating oil composition after the hot tube test were respectively determined by the hydrochloric acid method, and a residual percentage of base number was determined according to the following formula.

Residual percentage of base number (%)=[{Base number after the hot tube test (by the hydrochloric acid method)}/{Base number of new oil (by the hydrochloric acid method)}]×100

Production Examples

Production Example 1

Production of Substituted Hydroxy Aromatic Carboxylic Acid Ester Derivative

In a one-liter flask, 319 g (1 mol) of hexadecylphenol (a reaction product of 1-hexadecene and phenol) and 200 g of xylene were charged and stirred such that the system became uniform. The resultant was heated to 70° C., 80 g of a 48 weight % NaOH aqueous solution was added, and the contents were refluxed with xylene for 2 hours under a nitrogen gas steam, thereby distilling away water. The reaction solution was transferred into a one-liter autoclave, which was then pressurized with carbon dioxide at 10 kg/cm$^2$G, followed by undergoing reaction at 155° C. for one hour. The temperature was dropped to 80° C., the resultant was transferred into a 2-liter flask, 120 g of xylene was added, and the contents were stirred such that the system became uniform. Furthermore, 250 g of 20 weight % sulfuric acid was added over 30 minutes, followed by undergoing reaction for 1 hour. This reaction solution was washed with water to perform phase separation, and thereafter, filtration was performed, followed by distilling away the xylene. A yield of the resulting reaction product was 312 g. Subsequently, 300 g of the resulting reaction product and 100 g of hexadecylphenol were charged in a 500-mL flask and allowed to react with each other at 250° C. for 5 hours under a nitrogen gas stream, and the produced water and the hexadecylphenol were distilled away under reduced pressure at 250° C. A yield of the resulting reaction product was 195 g. As a result of the field desorption ionization mass spectrometry, the proton nuclear magnetic resonance spectroscopy, and the $C^{13}$ nuclear magnetic resonance spectroscopy, this product was confirmed to be a mixture of compounds represented by the following formulae (V) and (VI).

(V)

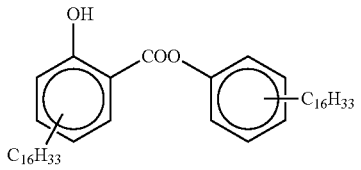

-continued (VI)

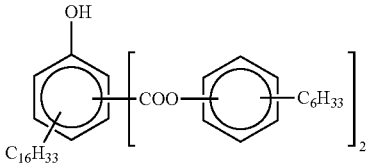

It should be noted that as a result of the liquid chromatographic analysis (detector: differential refractometer), a ratio of the compounds represented by these formulae (V) and (VI) was confirmed to be 78 area % for the compound of the formula (V) and 22 area % for the compound of the formula (VI), respectively.

Examples and Comparative Examples

Examples A1 to A3 and Comparative Examples A1 and A2

Lubricating oil compositions were prepared by blending additives in a base oil in a blending formulation shown in Table 1. Properties and performances of each of the resulting lubricating oil compositions were evaluated by the aforementioned methods. The results are shown in Table 1.

Examples B1 to B6 and Comparative Examples B1 to B7

Lubricating oil compositions for internal combustion engines were prepared by blending additives in a base oil in a blending formulation shown in Table 2. Properties and performances of each of the resulting lubricating oil compositions were evaluated by the aforementioned methods. The results are shown in Table 2.

Examples C1 to C3 and Comparative Examples C1 to C2

Lubricating oil compositions for internal combustion engines were prepared by blending additives in a base oil in a blending formulation shown in Table 3. Properties and performances of each of the resulting lubricating oil compositions were evaluated by the aforementioned methods. The results are shown in Table 3.

Examples D1 to D3 and Comparative Examples D1 to D2

Lubricating oil compositions for internal combustion engines were prepared by blending additives in a base oil in a blending formulation shown in Table 4. Properties and performances of each of the resulting lubricating oil compositions were evaluated by the aforementioned methods. The results are shown in Table 4.

TABLE 1

| | Example | | | Comparative Example | |
|---|---|---|---|---|---|
| | A1 | A2 | A3 | A1 | A2 |
| Blending amount | | | | | |
| Base oil *1 | Balance | Balance | Balance | Balance | Balance |
| Ester derivative *2 (mass %) | 5.00 | 5.00 | 5.00 | 5.00 | 0.00 |
| Heterocyclic compound-a *3 (mass %) | 1.00 | 0.00 | 0.00 | 0.00 | 1.00 |
| Heterocyclic compound-b *4 (mass %) | 0.00 | 0.50 | 0.00 | 0.00 | 0.00 |
| Heterocyclic compound-c *5 (mass %) | 0.00 | 0.00 | 0.50 | 0.00 | 0.00 |
| Metallic detergent *6 (mass %) | 2.00 | 2.00 | 2.00 | 2.00 | 2.00 |
| ZnDTP *7 (mass %) | 0.60 | 0.60 | 0.60 | 0.60 | 0.60 |
| Other additives *8 (mass %) | 23.85 | 23.85 | 23.85 | 23.85 | 23.85 |
| Content | | | | | |
| Phosphorus content (mass %) | 0.04 | 0.04 | 0.04 | 0.04 | 0.04 |
| Sulfated ash content(mass %) | 0.70 | 0.70 | 0.70 | 0.70 | 0.70 |
| Evaluation results | | | | | |
| Hot tube test (M.R) | 9.0 | 8.5 | 8.5 | 9.0 | 8.0 |
| Residual percentage of base number (%) | 43 | 38 | 38 | 20 | 27 |

TABLE 2

| | Example | | | | | | Comparative Example | | | | | | |
|---|---|---|---|---|---|---|---|---|---|---|---|---|---|
| | B1 | B2 | B3 | B4 | B5 | B6 | B1 | B2 | B3 | B4 | B5 | B6 | B7 |
| Blending amount | | | | | | | | | | | | | |
| Base oil*1 | Balance | Balance | Balance | Balance | Balance | Balance | Balance | Balance | Balance | Balance | Balance | Balance | Balance |
| Ester derivative*2 (mass %) | 5.00 | 5.00 | 5.00 | 5.00 | 5.00 | 5.00 | 0.00 | 5.00 | 0.00 | 0.00 | 5.00 | 5.00 | 0.00 |
| Heterocyclic compound-a*3 (mass %) | 1.00 | 0.00 | 0.00 | 1.00 | 1.00 | 1.00 | 0.00 | 0.00 | 1.00 | 1.00 | 0.00 | 0.00 | 1.00 |
| Heterocyclic compound-b*4 (mass %) | 0.00 | 0.50 | 0.00 | 0.00 | 0.00 | 0.00 | 0.00 | 0.00 | 0.00 | 0.00 | 0.00 | 0.00 | 0.00 |
| Heterocyclic compound-c*5 (mass %) | 0.00 | 0.00 | 0.50 | 0.00 | 0.00 | 0.00 | 0.00 | 0.00 | 0.00 | 0.00 | 0.00 | 0.00 | 0.00 |

TABLE 2-continued

| | Example | | | | | | Comparative Example | | | | | | |
|---|---|---|---|---|---|---|---|---|---|---|---|---|---|
| | B1 | B2 | B3 | B4 | B5 | B6 | B1 | B2 | B3 | B4 | B5 | B6 | B7 |
| Metallic detergent*6 (mass %) | 0.00 | 0.00 | 0.00 | 0.50 | 0.00 | 0.50 | 0.00 | 0.00 | 0.00 | 0.50 | 0.00 | 0.50 | 0.50 |
| ZnDTP*7 (mass %) | 0.00 | 0.00 | 0.00 | 0.00 | 0.30 | 0.30 | 0.00 | 0.00 | 0.00 | 0.00 | 0.30 | 0.30 | 0.30 |
| Other additives*8 (mass %) | 23.85 | 23.85 | 23.85 | 23.85 | 23.85 | 23.85 | 23.85 | 23.85 | 23.85 | 23.85 | 23.85 | 23.85 | 23.85 |
| Content | | | | | | | | | | | | | |
| Phosphorus content (mass %) | 0.00 | 0.00 | 0.00 | 0.00 | 0.02 | 0.02 | 0.00 | 0.00 | 0.00 | 0.00 | 0.02 | 0.02 | 0.02 |
| Sulfated ash content (mass %) | 0.02 | 0.02 | 0.02 | 0.16 | 0.08 | 0.22 | 0.02 | 0.02 | 0.02 | 0.16 | 0.08 | 0.22 | 0.22 |
| Evaluation results | | | | | | | | | | | | | |
| Hot tube test (M.R) | 7.5 | 7.0 | 7.0 | 8.0 | 7.0 | 7.5 | 4.0 | 7.0 | 3.5 | 4.0 | 3.0 | 7.0 | 3.5 |
| Residual percentage of base number (%) | 47 | 40 | 42 | 46 | 36 | 41 | 15 | 17 | 37 | 41 | 10 | 23 | 35 |

TABLE 3

| | Example | | | Comparative Example | |
|---|---|---|---|---|---|
| | C1 | C2 | C3 | C1 | C2 |
| Blending amount | | | | | |
| Base oil *1 | Balance | Balance | Balance | Balance | Balance |
| Ester derivative *2 (mass %) | 5.00 | 5.00 | 5.00 | 5.00 | 0.00 |
| Heterocyclic compound-a *3 (mass %) | 1.00 | 0.00 | 0.00 | 0.00 | 1.00 |
| Heterocyclic compound'b *4 (mass %) | 0.00 | 0.50 | 0.00 | 0.00 | 0.00 |
| Heterocyclic compound-c *5 (mass %) | 0.00 | 0.00 | 0.50 | 0.00 | 0.00 |
| Metallic detergent *6 (mass %) | 1.00 | 1.00 | 1.00 | 1.00 | 1.00 |
| ZnDTP *7 (mass %) | 0.30 | 0.30 | 0.30 | 0.30 | 0.30 |
| Other additives *8 (mass %) | 23.85 | 23.85 | 23.85 | 23.85 | 23.85 |
| Content | | | | | |
| Phosphorus content (mass %) | 0.02 | 0.02 | 0.02 | 0.02 | 0.02 |
| Sulfated ash content (mass %) | 0.35 | 0.35 | 0.35 | 0.35 | 0.35 |
| Evaluation results | | | | | |
| Hot tube test (M.R) | 8.0 | 7.5 | 7.5 | 7.5 | 4.0 |
| Residual percentage of base number (%) | 46 | 39 | 41 | 27 | 33 |

TABLE 4

| | Example | | | Comparative Example | |
|---|---|---|---|---|---|
| | D1 | D2 | D3 | D1 | D2 |
| Blending amount | | | | | |
| Base oil *1 | Balance | Balance | Balance | Balance | Balance |
| Ester derivative *2 (mass %) | 5.00 | 5.00 | 5.00 | 5.00 | 0.00 |
| Heterocyclic compound-a *3 (mass %) | 1.00 | 0.00 | 0.00 | 0.00 | 1.00 |
| Heterocychc compound-b *4 (mass %) | 0.00 | 0.50 | 0.00 | 0.00 | 0.00 |
| Heterocyclic compound-c *5 (mass %) | 0.00 | 0.00 | 0.50 | 0.00 | 0.00 |
| Metallic detergent *6 (mass %) | 0.50 | 0.50 | 0.50 | 0.50 | 0.50 |
| ZnDTP *7 (mass %) | 0.60 | 0.60 | 0.60 | 0.60 | 0.60 |
| Other additives *8 (mass %) | 23.85 | 23.85 | 23.85 | 23.85 | 23.85 |
| Content | | | | | |
| Phosphorus content (mass %) | 0.04 | 0.04 | 0.04 | 0.04 | 0.04 |
| Sulfated ash content (mass %) | 0.28 | 0.28 | 0.28 | 0.28 | 0.28 |
| Evaluation results | | | | | |
| Hot tube test (M.R) | 7.0 | 6.5 | 6.5 | 6.5 | 3.0 |
| Residual percentage of base number (%) | 42 | 36 | 37 | 18 | 25 |

It should be noted that the respective components used for the preparation of the lubricating oil compositions shown in Tables 1 to 4 are as follows.

*1: Hydrorefined mineral oil (100N, kinematic viscosity at 40° C.: 21.0 $mm^2/s$, kinematic viscosity at 100° C.: 4.5 $mm^2/s$, viscosity index: 127, sulfur content: less than 5 ppm by mass)

*2: Ester derivative (the substituted hydroxy aromatic carboxylic acid ester derivative produced in the foregoing Production Example 1)

*3: Heterocyclic compound-a (the compound represented by the following chemical formula, "XPDL-590", manufactured by BASF)

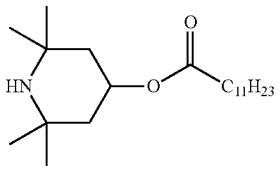

*4: Heterocyclic compound-b (the compound represented by the following chemical formula, "TINUVIN 770", manufactured by BASF)

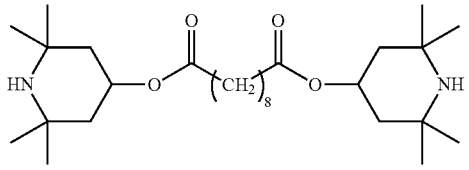

*5: Heterocyclic compound-c (the compound represented by the following chemical formula, "TINUVIN 765", manufactured by BASF)

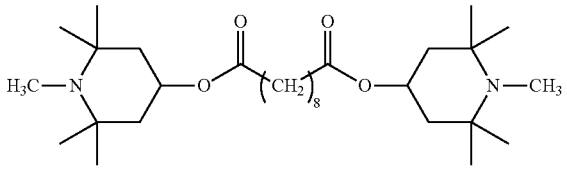

*6: Metallic detergent: Calcium phenate (base number: 300 mgKOH/g)

*7: Zinc dialkyldithiophosphate (secondary alkyl group, carbon number: 8)

*8: Other additives: Metal deactivator (alkylbenzotriazole), silicone-based defoaming agent, amine-based antioxidant, phenol-based antioxidant, dispersants (including monoimide, bisimide, and boronated monoimide), and viscosity modifiers (OCP and PMA)

As is clear from Table 1, in the lubricating oil compositions of Examples A1 to A3 in which the phosphorus content is 0.06 mass % or less on the basis of a total amount of the composition, and the sulfated ash content is 0.5 mass % or less on the basis of a total amount of the composition, in view of the fact that the substituted hydroxy aromatic carboxylic acid ester derivative (A) and the heterocyclic compound (B) were blended, the residual percentage of base number after the hot tube test was high as compared with that in the lubricating oil compositions of Comparative Examples A1 and A2. According to this, it was noted that the lubricating oil compositions according to the present Examples A1 to A3 are able to maintain the high-temperature detergency and are excellent in long-drain properties.

As is clear from Table 2, it was noted that the lubricating oil compositions of Examples B1 to B6 in which the phosphorus content is 0.03 mass % or less, and the sulfated ash content is 0.3 mass % or less on the basis of a total amount of the composition are favorable in the hot tube test and residual base number as compared with those of Comparative Examples B1 to B7.

As is clear from Table 3, the lubricating oil compositions of Examples C1 to C3 in which the phosphorus content is 0.03 mass % or less, and the sulfated ash content is 0.5 mass % or less were higher in the residual percentage of base number ratio after the hot tube test than those of Comparative Examples C1 and C2.

As is clear from Table 4, the lubricating oil compositions of Examples D1 to D3 in which the phosphorus content is 0.06 mass % or less on the basis of a total amount of the composition, and the sulfated ash content is 0.3 mass % or less on the basis of a total amount of the composition were higher in the residual percentage of base number after the hot tube test than those of Comparative Examples D1 and D2.

The invention claimed is:

1. A lubricating oil composition comprising:

a base oil, a substituted hydroxy aromatic carboxylic acid ester derivative represented by at least one of formula (I) and formula (II) in an amount of from 1 mass % to 7 mass % on the basis of a total amount of the composition, and a heterocyclic compound represented by formula (III) or (IV) blended therein in an amount of from 0.05 mass % to 3 mass % on the basis of a total amount of the composition;

wherein:

a phosphorus content in the lubricating composition is 0.06 mass % or less on the basis of a total amount of the composition;

a sulfated ash content in the lubricating composition is 0.5 mass % or less on the basis of a total amount of the composition;

(I)

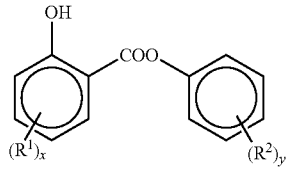

in formula I:

each of x and y is an integer satisfying $1 \leq x \leq 3$ and $1 \leq y \leq 3$, respectively, each of $R^1$ and $R^2$ represents an alkyl group having 9 to 20 carbon atoms and may be the same as or different from each other, and in the case of $2 \leq x \leq 3$ and $2 \leq y \leq 3$, plural $R^1$s may be the same as or different from each other and plural $R^2$s may be the same as or different from each other;

(II)

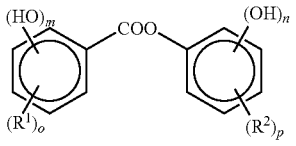

in the formula II:

each of m, n, o, and p is an integer satisfying $1 \leq m \leq 2$, $0 \leq n \leq 2$, $2 \leq (m+n) \leq 4$, $1 \leq o \leq 3$, and $1 \leq p \leq 3$, respectively, each of $R^1$ and $R^2$ represents an alkyl group having 9 to 20 carbon atoms and may be the same as or different from each other, and in the case of $2 \leq o \leq 3$ and $2 \leq p \leq 3$, plural $R^1$s may be the same as or different from each other and plural $R^2$s may be the same as or different from each other; and (III)

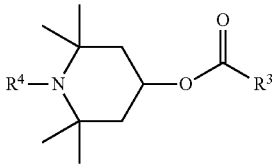

(IV)

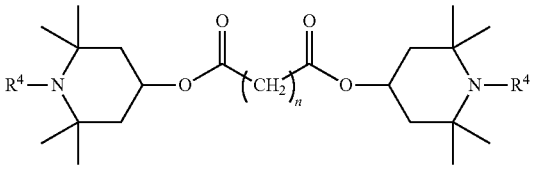

in formula (III) and formula (IV):

$R^3$ represents a linear or branched alkyl group having 7 to 17 carbon atoms, n is 6 to 18, each $R^4$ is independently selected from the group consisting of a hydrogen atom, an alkyl group having 1 to 18 carbon atoms, a —$COR^5$ group, and an —$OR^6$ group, $R^5$ is an alkyl group having 1 to 17 carbon atoms, and $R^6$ is an alkyl group having 1 to 18 carbon atoms, wherein the lubricating oil composition has a residual percentage of base number of from 36 to 47% determined as Residual percentage of base number (%)=[{Base number after the hot tube test (by the hydrochloric acid method)}/{Base number of new oil (by the hydrochloric acid method)}]×100.

2. The lubricating oil composition according to claim 1, wherein in the lubricating oil composition:

the phosphorus content is 0.06 mass % or less on the basis of a total amount of the composition, and the sulfated ash content is 0.3 mass % or less on the basis of a total amount of the composition.

3. The lubricating oil composition according to claim 1, wherein in the lubricating oil composition:

the phosphorus content is 0.03 mass % or less.

4. The lubricating oil composition according to claim 1, wherein in the lubricating oil composition:

the phosphorus content is 0.03 mass % or less, and the sulfated ash content is 0.3 mass % or less on the basis of a total amount of the composition.

5. The lubricating oil composition according to claim 1, further comprising at least one of an antioxidant and a dispersant.

6. The lubricating oil composition according to claim 1, wherein in formula (III) or (IV), $R^4$ is a hydrogen atom or a methyl group.

7. The lubricating oil composition according to claim 6, wherein in formula (III) or (IV), $R^4$ is a hydrogen atom.

8. A method for lubricating an internal combustion engine, comprising:

applying the lubricating oil composition according to claim 1 to the internal combustion engine.

9. The lubricating oil composition according to claim 1, wherein each of $R^1$ and $R^2$ are each independently an alkyl group having 16 to 20 carbon atoms.

10. The lubricating oil composition according to claim 9, wherein $R^4$ is a hydrogen atom or a methyl group and n is 8 to 18.

11. The lubricating oil composition according to claim 1, wherein the substituted hydroxy aromatic carboxylic acid ester derivative is present in an amount of from 2 to 6 mass % based on the total mass of the composition.

12. The lubricating oil composition according to claim 1, wherein the heterocyclic compound is present in an amount of from 0.1 to 2 mass % based on the total mass of the lubricating oil composition.

13. The lubricating oil composition according to claim 1, wherein the heterocyclic compound is present in an amount of from 0.5 to 2 mass %.

14. The lubricating oil composition according to claim 1, comprising a metallic detergent in an amount of 1.00 mass % or less and ZnDTP in an amount of 0.60 mass % or less.

15. The lubricating oil composition according to claim 1, comprising the substituted hydroxy aromatic carboxylic acid ester derivative of formula (I) wherein $R^1$ and $R^2$ are, independently, an alkyl group having 16 to 20 carbon atoms, and the substituted hydroxy aromatic carboxylic acid ester derivative is present in an amount of from 5 to 7 mass % based on the total mass of the lubricating oil composition, wherein the heterocyclic compound $R^4$ is a hydrogen atom or a methyl group and $R^3$ has 11 to 17 carbon atoms, and the heterocyclic compound is present in a total amount of from 0.050 to 1.00 mass % based on the total mass of the composition, 0.60 mass % or less of ZnDTP, and 1.00 mass % or less of metallic detergents, and a phosphorous content of 0.04 mass % or less.

16. The lubricating oil composition according to claim 1 in the form of a diesel fuel, comprising hydro-refined mineral oil having a kinematic viscosity at 100° C. of 1.5 $mm^2/s$-15 $mm^2/s$ and a viscosity index of 120 or more.

17. The lubricating oil composition according to claim 1, wherein the base oil is a mineral oil.

* * * * *